US009370221B1

(12) United States Patent
Hsu et al.

(10) Patent No.: US 9,370,221 B1
(45) Date of Patent: Jun. 21, 2016

(54) SHOCK ABSORBING AND PRESSURE RELEASING DAMPER APPARATUS FOR FOOTWEAR

(71) Applicants: Ming-Wen Hsu, Taipei (TW); Chun-Hao Hsu, Taipei (TW); Wei-Lun Hsu, Taipei (TW)

(72) Inventors: Ming-Wen Hsu, Taipei (TW); Chun-Hao Hsu, Taipei (TW); Wei-Lun Hsu, Taipei (TW)

( * ) Notice: Subject to any disclaimer, the term of this patent is extended or adjusted under 35 U.S.C. 154(b) by 0 days.

(21) Appl. No.: 14/835,721

(22) Filed: Aug. 26, 2015

(51) Int. Cl.
*A43B 13/18* (2006.01)
*A43B 1/00* (2006.01)
*A43B 7/08* (2006.01)

(52) U.S. Cl.
CPC ..... *A43B 13/181* (2013.01); *A43B 1/0054* (2013.01); *A43B 7/087* (2013.01); *A43B 13/182* (2013.01)

(58) Field of Classification Search
CPC .. A43B 13/182; A43B 13/183; A43B 1/0054; A43B 7/087
USPC ..... 36/27, 28, 102
See application file for complete search history.

(56) References Cited

U.S. PATENT DOCUMENTS 5,224,278 A * 7/1993 Jeon ..... A43B 13/203 36/27
5,544,431 A * 8/1996 Dixon ..... A43B 21/30 36/27
7,152,339 B2 * 12/2006 Lo ..... A43B 7/08 36/27
8,069,586 B2 * 12/2011 Orvitz ..... A43B 7/141 36/100
2003/0217483 A1 * 11/2003 Abraham ..... A43B 13/182 36/28
2007/0209233 A1 * 9/2007 Kim ..... A43B 7/082 36/27
2014/0352176 A1 * 12/2014 Chang ..... A43B 13/183 36/102
2015/0157091 A1 * 6/2015 Hsu ..... A43B 13/386 36/44

FOREIGN PATENT DOCUMENTS

CN 203446700 U 2/2014
CN 204015287 U 12/2014
TW DE 202014100267 U1 * 2/2014 ..... A43B 13/182
WO WO 2005034671 A1 * 4/2005 ..... A43B 1/0054

* cited by examiner

*Primary Examiner* — Ted Kavanaugh

(57) ABSTRACT

A shock absorbing and pressure releasing damper apparatus for footwear includes: an upper board having upper mounting portions on a bottom thereof; a lower board arranged at the bottom of the upper board and having lower mounting portions corresponding to the upper mounting portions of the upper board on a top thereof; a middle cushion member disposed between the upper and lower board and including slits; elastic members arranged between the upper mounting portions and the lower mounting portions; magnetic members arranged inside the upper and lower mounting portions of the upper and lower boards and at centers of the elastic members.

15 Claims, 7 Drawing Sheets

SHOCK ABSORBING AND PRESSURE RELEASING DAMPER APPARATUS FOR FOOTWEAR

BACKGROUND OF THE INVENTION

1. Field of the Invention

The present invention is related to a damper apparatus capable of rising up and lowering down depending upon different reaction forces exerted on the damper apparatus provided at an insole portion of a shoe body, which is also capable of immediately distributing and absorbing different pressures exerted by the foot during walking, running and jumping as well as to generate air flows at the shoe insole.

2. The Prior Arts

People wear shoes to protect their feet from injuries. Under the weight of the human body, reaction forces exerted upon the feet by the ground during walking, running or jumping are conveyed from the feet to the knees, making such forces ranging from one to several times of body weight. However, the structure of conventional shoe only provides one shoe insole at the bottom of the shoe with a view to achieving the wearing comfort and softness. However, due to the fact that such shoe insole is not of a compressive structure, as the user wears the shoe for walking, running and jumping, the shoe insole is incapable of rising and lowering according to the reaction forces. As a result, the reaction forces generated by the ground cannot be distributed and absorbed and there is no damping or protection effect at all. Such reaction forces transferred from the feet to the knees can cause serious damage thereto. Although there have been newly invented air-cushion shoes, such air-cushion shoes only provide an air-saturated air chamber, which can easily lose their functionalities as tiny rocks or foreign bodies penetrate therethrough. In addition, as the shoe insoles of such structure are subject to the forces exerted by the feet, the heights of the air-cushion shoes are still permanent and are not reducible, which means the shoe insoles cannot be adjusted according to different reaction forces exerted on the feet. As a result, when the shoe insoles are subject to different reaction forces, the shoes cannot effectively distribute and absorb the pressures. Consequently, the feet and knees are prone to injures due to impacts. Furthermore, the shoe insoles of known shoes cannot generate air flows, and in consequence there is no exchange between the hot air from the feet and the ambient air; as a result, the inside of the shoes are stuffy and stinky, thereby reducing the practicability of the shoes.

In order to overcome the disadvantages of convention shoes mentioned above, the applicant put forward an insole anti-shock decompression buffer structure (CN203446700 U), which includes an upper layer plate, a lower layer plate and a plurality of internal and external springs disposed between the layer plates. The height of the insole anti-shock decompression buffer structure is variable based on the different pressures applied on the buffer structure, thereby providing a better buffering effect. Then, the applicant put forward another insole shock absorption and pressure reduction buffer (CN204015287 U), which includes an upper layer plate, a lower layer plate and a plurality of springs and magnets disposed between the layer plates. The insole shock absorption and pressure reduction buffer provides multi stages of cushion effects. However, because the springs are not always compressed in the vertical direction, the buckling of the spring would likely happen, which reduce the serving life of the spring. Moreover, the cushion effect of the buffer structures could be further improved.

SUMMARY OF THE INVENTION

A primary objective of the present invention is to provide a shock absorbing and pressure releasing damper apparatus for footwear that overcomes the disadvantages of convention designs mentioned above.

In order to achieve the objective, a shock absorbing and pressure releasing damper apparatus for footwear according to the present invention includes an upper board, a lower board, a middle cushion member, a plurality of elastic members, and a plurality of magnetic members.

The upper board has a plurality of upper mounting portions disposed on a bottom of the upper board.

The lower board is arranged at the bottom of the upper board and includes a plurality of lower mounting portions corresponding to the upper mounting portions of the upper board on a top thereof.

The middle cushion member is arranged between the upper board and the lower board. The middle cushion member includes a plurality of confining through holes corresponding to the upper mounting portions of the upper board and the lower mounting portions of the lower board.

The elastic members are arranged between the upper mounting portions of the upper board and the lower mounting portions of the lower board.

The magnetic members are arranged inside the upper and lower mounting portions of the upper and lower boards and at centers of the elastic members. The magnetic members have magnetic polarities.

Preferably, the upper board and the lower board of the present invention include a plurality of ribs.

Preferably, the upper mounting portions of the upper board and the lower mounting portions of the lower board of the present invention are of an outwardly protruding shape, and inwardly concave fixation spaces are disposed at inner and outer of the upper mounting portions of the upper board and the lower mounting portions of the lower board, respectively.

Preferably, the upper mounting portions of the upper board and the lower mounting portions of the lower board of the present invention are defined with inner and outer fixation spaces of a step inwardly concave shape.

Preferably, the middle cushion member of the present invention includes a plurality of slits.

Preferably, the elastic members of the present invention are springs.

Preferably, the elastic members of the present invention include a first elastic member and a second elastic member disposed in the first elastic members to form a duo spring structure.

Preferably, the magnetic polarities of the corresponding upper and lower mounting portions on the upper and lower boards of the present invention are of like poles repelling each other.

Furthermore, the damper apparatus operates in conjunction with a shoe body, and the shoe body includes an insole portion having a receiving portion for accommodating the damper apparatus.

Furthermore, the upper board of the present invention further includes a plurality of ventilation holes.

Furthermore, the lower board of the present invention further includes a plurality of ventilation holes.

Furthermore, the middle cushion member of the present invention further includes a plurality of cushion ventilation holes.

Furthermore, a pad with ventilation holes is disposed on the damper apparatus of the present invention.

Accordingly, the damper apparatus provided at the insole portion of the shoe body is able to rise up and lower down depending upon different reaction forces as well as to immediately distribute and absorb different pressures exerted by the front and rear of the foot during walking, running and jumping in addition to the generation of air flow at the shoe insole such that the shock absorbing and pressure releasing effects as well as the wearing comfort and air flows of the shoe can all be enhanced, which is novel and inventive and meets users' need.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
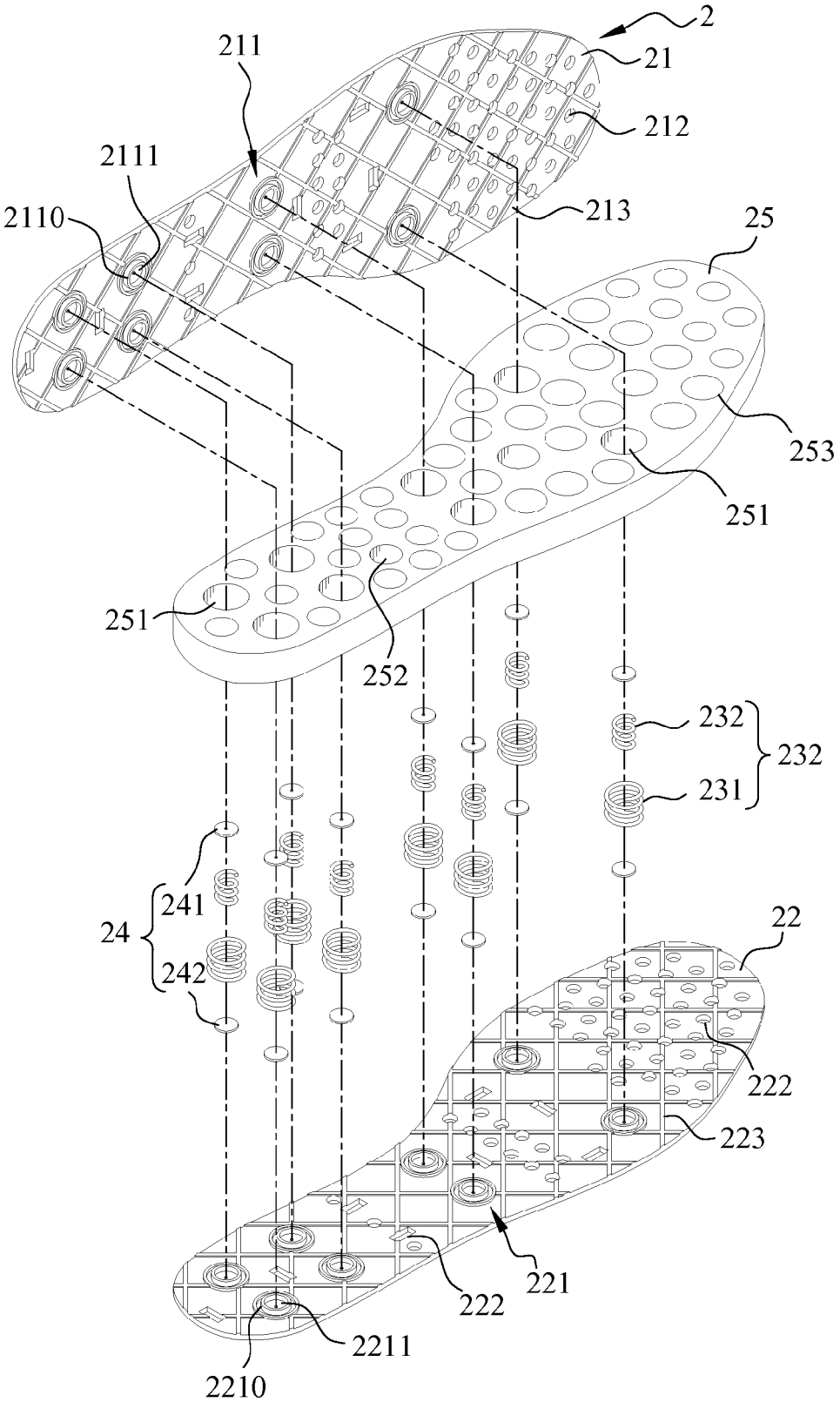
FIG. 1 is an exploded view showing a damper apparatus according to a first embodiment of the present invention.

To assist the examiner in understanding the technical features, content, merits and the achievable effects of the present invention, the following provides a detailed description of the embodiments of the present invention along with the accompanied drawings; however, the drawings provided are for illustrative purposes only, which may not be presented in actual scales and exact configurations; in other words, the scales and configuration relationship shown in the drawings shall not be treated as limitations of the present invention for actual implementations.

Figure 2:
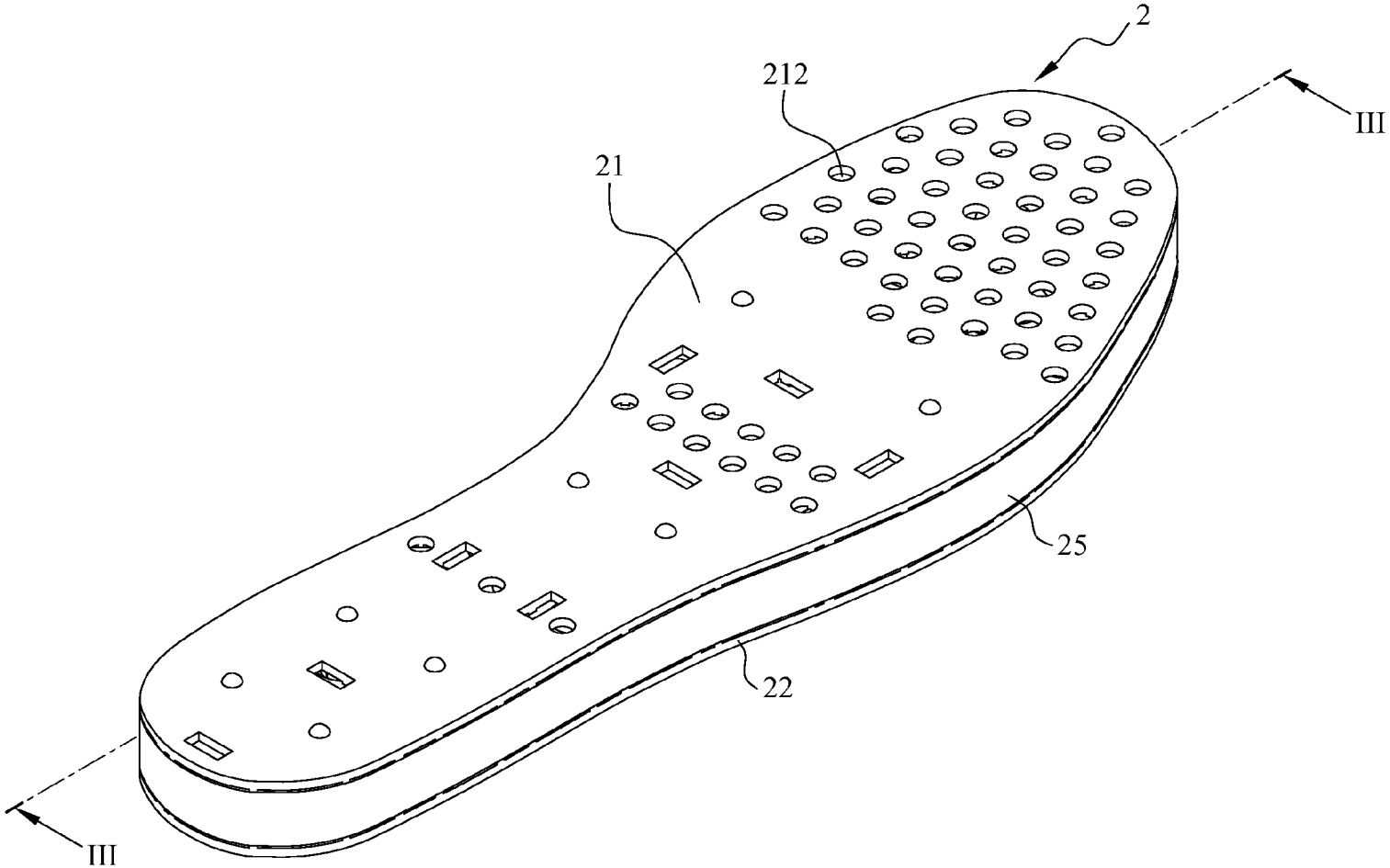
FIG. 2 is a perspective view showing the damper apparatus of FIG. 1.
Figure 3:
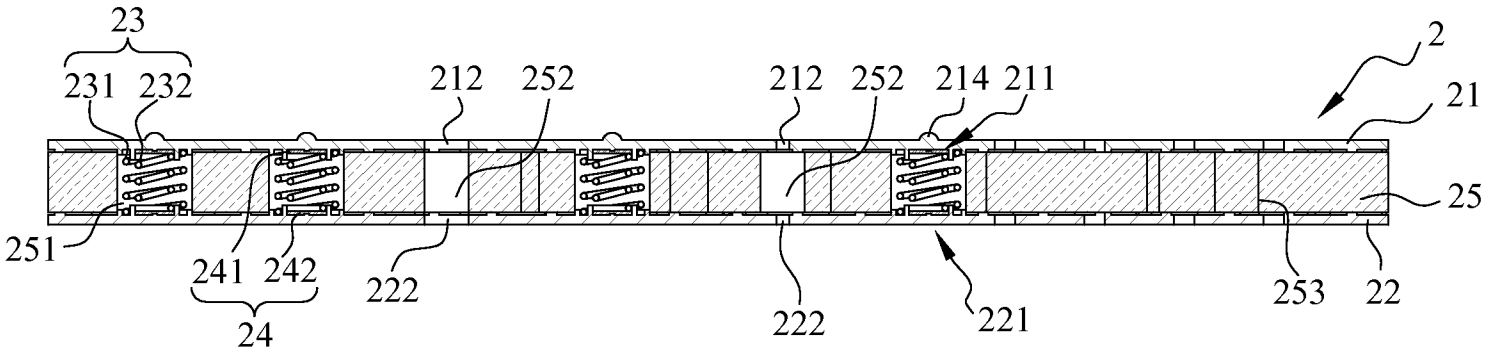
FIG. 3 is a cross sectional view showing the damper apparatus of FIG. 1.

Referring to FIGS. 1 to 3, a shock absorbing and pressure releasing damper apparatus 2 for footwear according to a preferred embodiment of the present invention comprises an upper board 21, a lower board 22, a middle cushion member 25, a plurality of elastic members 23 and a plurality of magnetic members 24.

Figure 4:
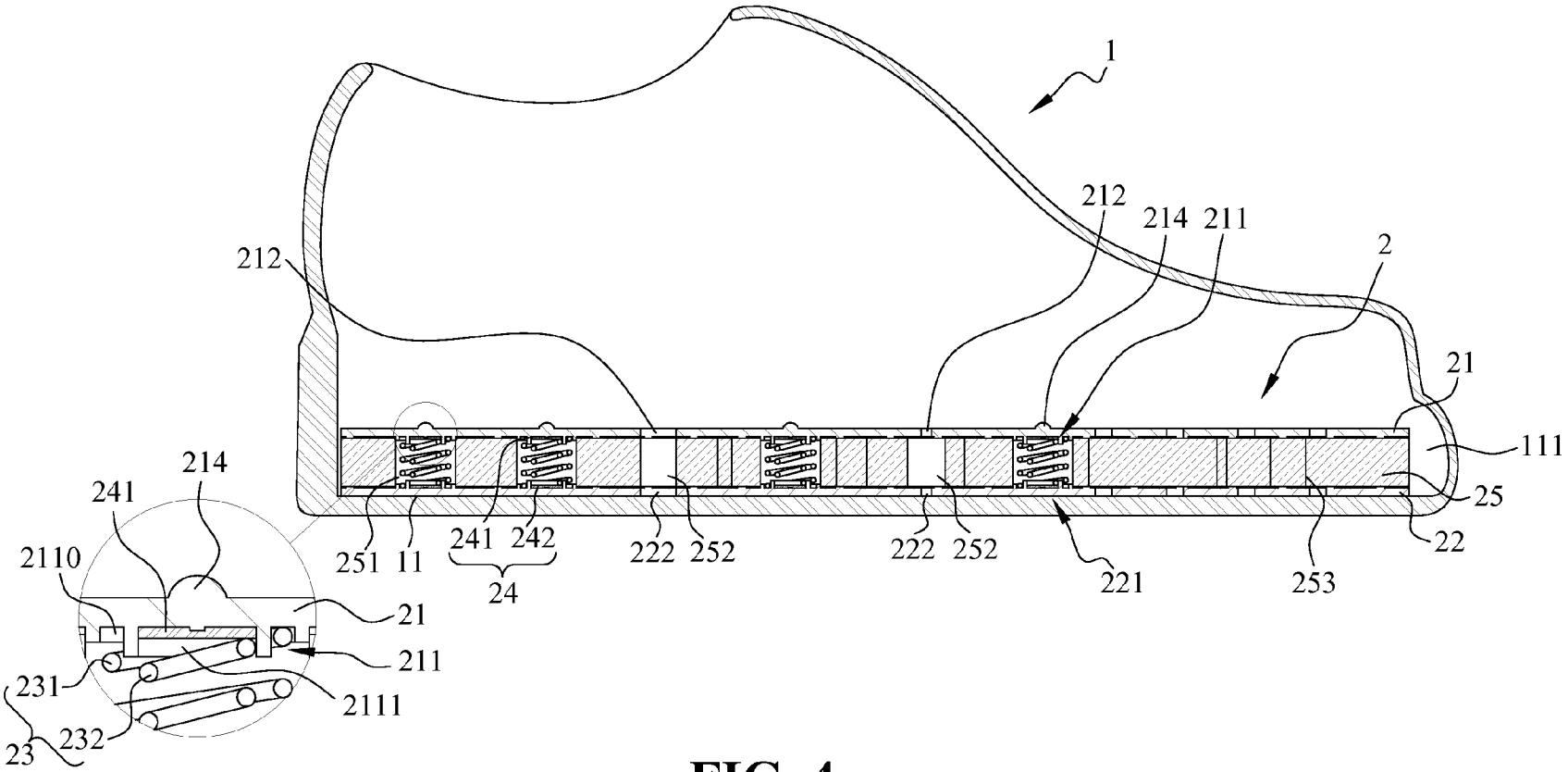
FIG. 4 is an illustration showing that the damper apparatus of FIG. 1 is placed in a shoe body.
Figure 5:
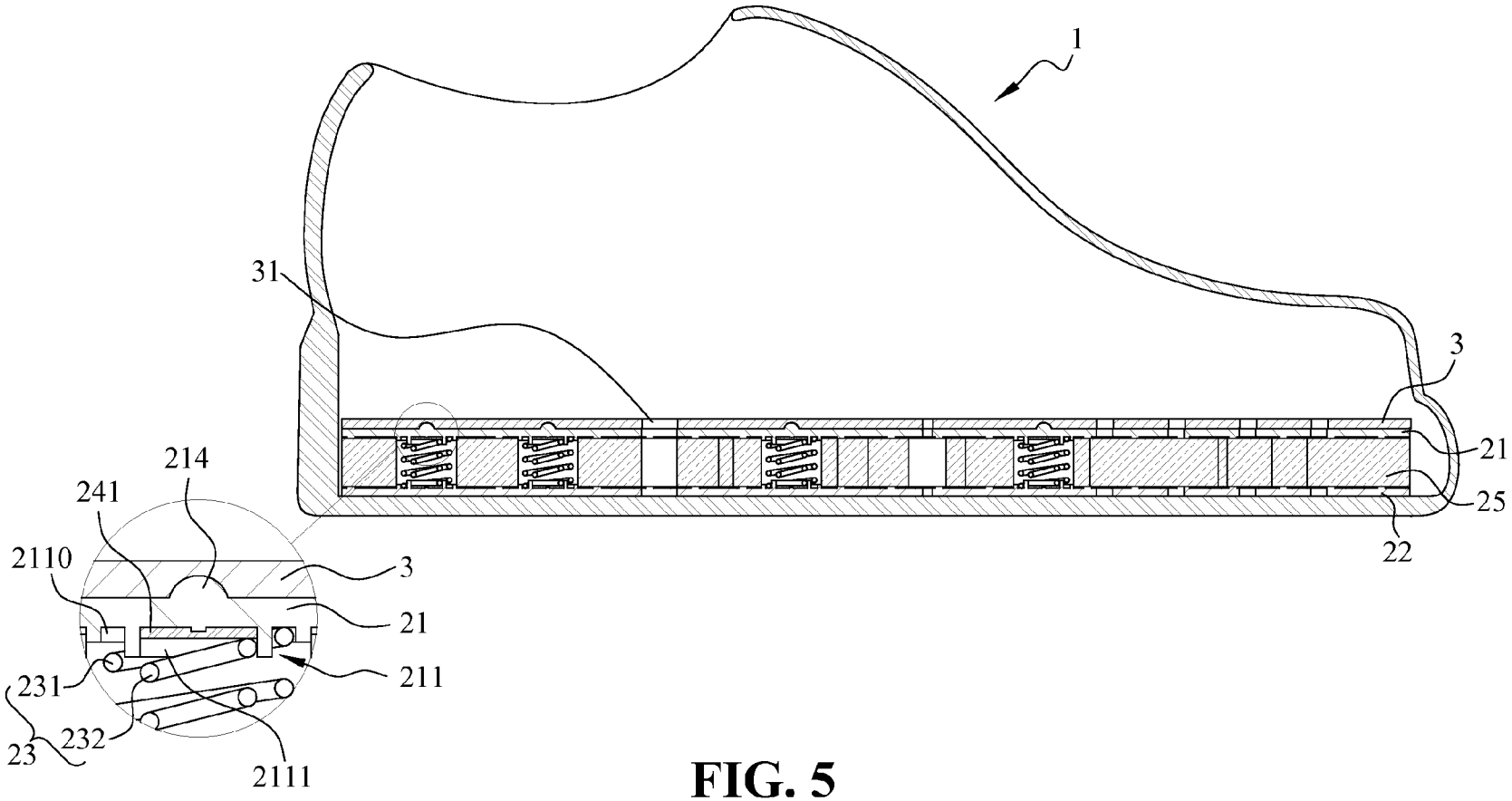
FIG. 5 is an illustration showing that a pad is provided on the damper apparatus of FIG. 4.
Figure 6:
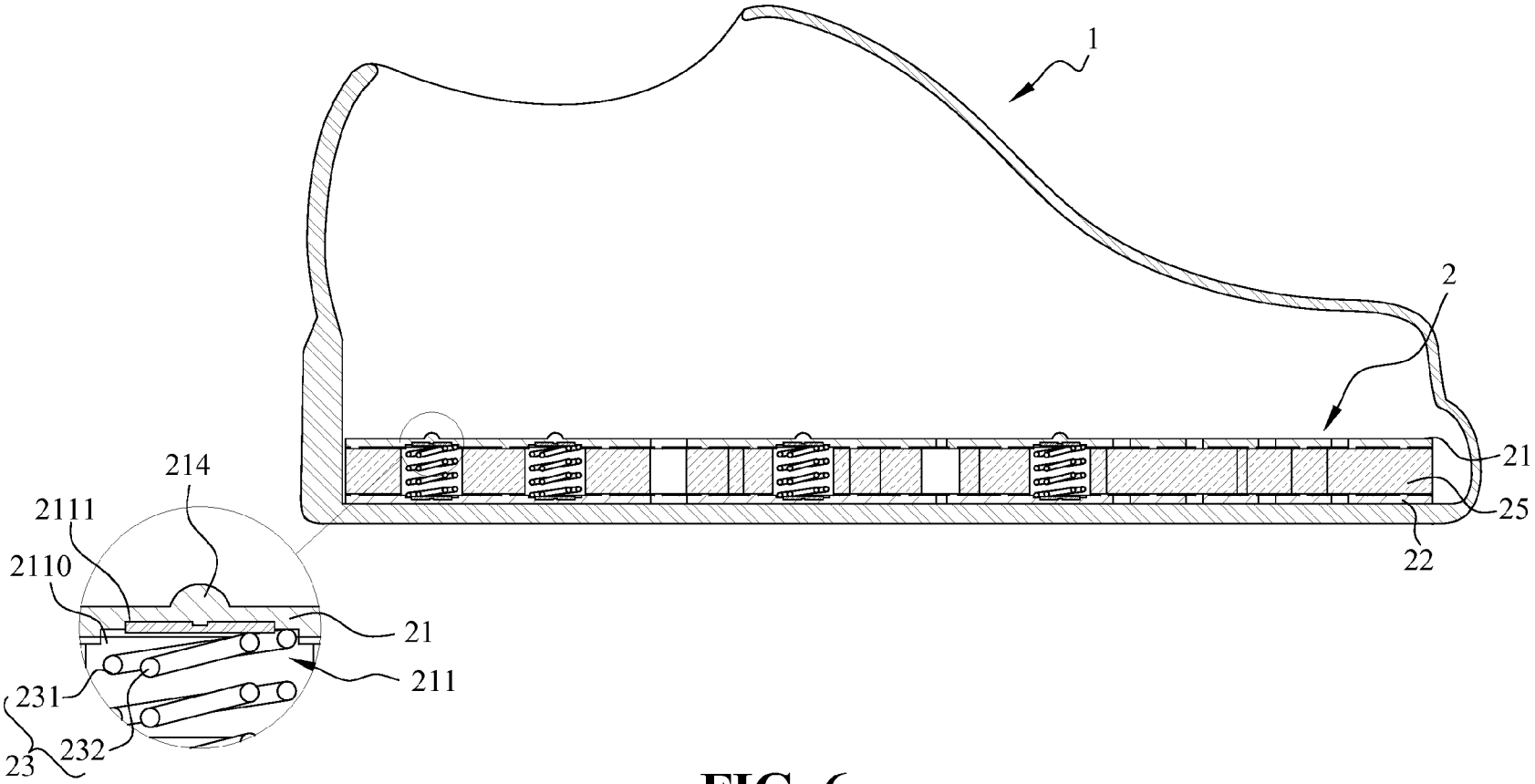
FIG. 6 is an illustration showing that a damper apparatus according to a second embodiment of the present invention is placed in the shoe body.

The upper board 21 includes a plurality of upper mounting portions 211 disposed on a bottom of the upper board 21. According to a first embodiment, the upper mounting portions 211 of the upper boards 21 are of an outwardly protruding shape and are respectively defined with an outer fixation space 2110 and an inner fixation space 2111 disposed at the outer and inner thereof, respectively as shown in FIGS. 4 and 5. However, the present invention is not limited to such shape. The upper mounting portion 211 of the upper board 21 according to a second embodiment can also be defined with an outer fixation space 2110 and an inner fixation space 2111 of a step inwardly concave shape as shown in FIG. 6, which falls within the protection scope of the present invention. In addition, in order to allow the shock absorbing and pressure releasing damper apparatus 2 according to the present invention to have air flow therethrough, the upper board 21 can be further provided with a plurality of ventilation holes 212 penetrating therethrough. In order to enhance the strength of the damper apparatus 2, a plurality of ribs 213 are provided on the upper board 21. According to the preferred embodiment, the ribs 213 are arranged on a bottom of the upper board 21 but the present invention is not limited to such arrangement. In other words, the ribs 213 can also be provided on a top of the upper board 21 and they fall within the protection scope of the present invention. The ribs 213 may be arranged in crisscross patterns as shown in FIG. 1 or parallel rows (not shown in the drawings). In order to provide a massage effect, the upper board 21 includes a plurality of massage members disposed on the top thereof. The massage members 214 are located at positions corresponding to the upper mounting portion 211. Alternatively, the massage members 214 are distributed all over the top of the upper board 21. Preferably, the massage members are distributed on the upper board 21 at positions corresponding to the acupuncture points of the foot to provide a better reflexology effect. Furthermore, the massage members may have various sizes corresponding to the acupuncture points of the foot.

The lower board 22 is disposed below the upper board 21. A plurality of lower mounting portions 221 corresponding to the upper mounting portions 211 of the upper board 21 is disposed on a top of the lower board 22. In addition, the lower mounting portions 221 of the lower board 22 according to the first embodiment are of an outwardly protruding shape and are defined with an outer fixation space 2210 and an inner fixation space 2211 (similar to the outer fixation space 2110 and inner fixation space 2111 shown in FIGS. 4 and 5) disposed at the outer and inner of the lower mounting portions 221 as shown in FIG. 1, respectively. However, the present invention is not limited to such shape. Similar to the upper mounting portion 211, the lower mounting portion 221 of the lower board 22 according to the second embodiment can also be defined with an outer fixation space 2210 and an inner fixation space 2211 of a step inwardly concave shape similar to the outer fixation space 2110 and inner fixation space 2111 shown in FIG. 6, which falls within the protection scope of the present invention. In addition, in order to allow the damper apparatus 2 according to the present invention to have air flow therethrough, the lower board 22 can be further provided with a plurality of ventilation holes 222. In order to enhance the strength of the damper apparatus 2, a plurality of ribs 223 are provided on the lower board 22. According to the preferred embodiment, the ribs 223 are arranged on a top of the lower board 22 but the present invention is not limited to such arrangement. In other words, the ribs 223 can also be provided on a bottom of the lower board 22 and they fall within the protection scope of the present invention. The ribs 223 may be arranged in crisscross patterns as shown in FIG. 1 or in parallel rows (not shown in the drawings). In order to reduce the weight of the footwear, the lower board 22 can gradually reduce its thickness from a rear end of the lower board 22 to the front end of the lower board 22 as shown in FIG. 1. Moreover, because the shoe toe bears less weight than the shoe heel, part of the front portion of the lower board 22 can be omitted (not shown in the drawings) to further reduce its weight.

The middle cushion member 25 is disposed between the upper board 21 and the lower board 22. The middle cushion member 25 is provided with a plurality of confining through holes 251 corresponding to the upper mounting portions 211 of the upper board 21 and the lower mounting portions 221 of the lower board 22. The middle cushion member 25 includes a plurality of cushion ventilation holes 252 communicating with the ventilation holes 212 of the upper board 21 and the ventilation holes 222 of the lower board 22 to provide the air ventilation. Moreover, a plurality of slits 253 can be further defined and distributed all over the middle cushion member 25 to further absorb the deformation energy. The slits 253 do not cut through the middle cushion member 25 and therefore the circular portions inside the annular slits are still attached to the middle cushion member 25. The middle cushion member 25 is made of a foam material. Preferably, the middle cushion member 25 is made of a material having viscoelastic property, such as a memory foam. Similar to the lower board 22, the middle cushion member 25 gradually reduces its thickness from a rear end thereof to the front end thereof as shown in FIG. 1.

Referring to FIGS. 1 and 3, the elastic members 23 are arranged between the upper mounting portions 211 of the upper board 21 and the lower mounting portions 221 of the lower board 22, and received in the confining through holes 251 of the middle cushion member 25. Because the elastic members 23 are received in the confining through holes 251, the confining through holes 251 place a limit on the deflection of the elastic members 23. Thus, buckling of the elastic members 23 can be prevented. According to the preferred embodiments, the elastic members 23 are springs. However, the present invention is not limited to such springs as they can also be other types of elastic members 23 having elasticity, which fall within the protection scope of the present invention. When the upper and lower mounting portions 211, 221 of the upper and lower boards 21, 22 according to the first embodiment of the present invention are of the outwardly protruding shape and are defined with the fixation spaces 2111, 2211 and 2110, 2210 at the inner and outer thereof respectively, first elastic members 231 of the elastic members 23 are fixed at the outer fixation spaces 2110, 2210 of the upper and lower mounting portions 211, 221 as shown in FIGS. 4 and 5. When the upper and lower mounting portions 211, 221 of the upper and lower boards 21, 22 according to the second embodiment of the present invention are of the step inwardly concave shape, the first elastic members 231 of the elastic members 23 are fixed at the outer fixation spaces 2110, 2210 of the upper and lower mounting portions 211, 221 as shown in FIG. 6. Moreover, the elastic member 23 may further include a second elastic member 232 disposed inside of the first elastic member 231 to form a duo spring structure. Similar to the first elastic members 231, the second elastic members 232 are fixed at the inner fixation spaces 2111, 2211 of the upper and lower mounting portions 211, 221 as shown in FIGS. 4 to 6. Preferably, the first elastic members 231 have an elastic coefficient different from that of the second elastic members 232.

The magnetic members 24 include a first magnetic member 241 and a second magnetic member 242. The first magnetic members 241 are arranged inside the upper mounting portions 211 of the upper board 21 and at the centers of the elastic members 23, and the second magnetic members 242 are arranged inside the lower mounting portions 221 of the lower board 22 and at the centers of the elastic members 23. The first and second magnetic members 241, 242 have magnetic polarities, which are provided to generate repulsive forces between the upper and lower boards 21 and 22. The magnetic members 24 arranged on the upper and lower mounting portions 211, 221 of the upper and lower boards 21, 22 are of like poles repelling each other.

Referring to FIG. 5, a pad 3 is attached to the upper board 21 of the damper apparatus 2. The pad 3 is provided with a plurality of ventilation holes 31 distributed all over the pad 3 for ventilation purpose. Alternatively, the ventilation holes 31 are located at positions corresponding to the ventilation holes 212 of the upper board 21, the cushion ventilation holes 252 of the middle cushion member 25 and the ventilation holes 222 of the lower board 21. The pad 3 is preferably made of a material softer than that of the upper and lower boards 21, 22, which makes the damper apparatus 2 more comfortable. Moreover, due to the softness of the pad 3, the pad 3 can conform to the bottom of the foot 4.

Figure 7:
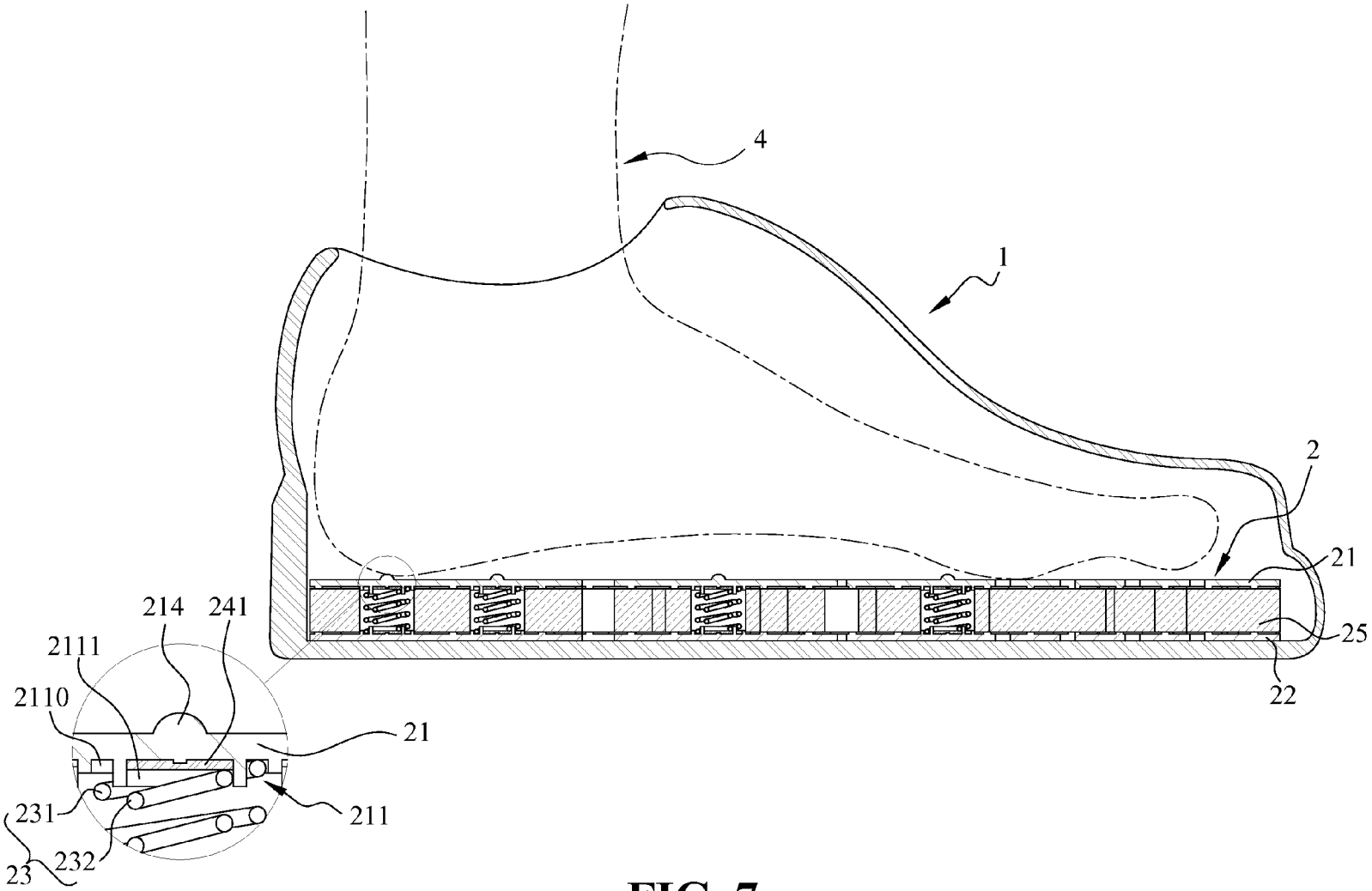
FIG. 7 is an illustration showing the damper apparatus of FIG. 1 in reaction with the foot pressing downward.

Please referring to FIGS. 4, 5 and 7, FIG. 4 shows the damper apparatus 2 according to the first embodiment of the present invention operating in conjunction with the shoe body 1. FIG. 5 shows that the damper apparatus 2 of FIG. 4 is further provided with the pad 3. FIG. 7 shows the damper apparatus 2 of FIG. 4 reacting with the foot 4. The shoe body 1 includes an insole portion 11, and the insole portion 11 has a receiving portion 111 for accommodating the damper apparatus 2. FIG. 4 illustrates the use of the damper apparatus 2 of the present invention, and the damper apparatus 2 is placed in the receiving portion 111 of the insole portion 11 of the shoe body 1. FIG. 5 illustrates that the pad 3 having a plurality of ventilation holes 31 is disposed on the upper board 21. As shown in the drawings, when the shoe body 1 is worn by the foot 4, the damper apparatus 2 is invisible from the outside of the shoe body 1. Thus, the damper apparatus 2 of the present invention does not affect the outer appearance of the shoe body 1. When a user walks and presses downward on the shoe body 1, the damper apparatus 2 of the present invention provides multi stages of cushion effects. In the beginning, the massage members 214 are pressed against the bottom of the foot 4, which provides the effect of foot massage. Secondly, when the foot 4 keeps pressing on the damper apparatus 2, the elastic members 23 are compressed. The more the elastic members 23 are compressed, the greater reaction forces are applied on the foot 4. Because the first and second elastic members 231, 232 have different elastic coefficients, the second elastic members 232 with smaller wire diameter, more number of turns and smaller spring diameter firstly react to the compression for a smaller reaction force, and the first elastic members 231 with larger wire diameter, less number of turns and larger spring diameter then also be compressed for a larger reaction force. Thirdly, when the foot 4 further presses on the damper apparatus 2, the first and second magnetic members 241, 242 having the same magnetic polarity generate the repulsive forces. The closer the magnetic members 241, 242 are, the greater the repulsive forces are applied on the foot 4. During the process, the middle cushion member 25 disposed between the upper board 21 and the lower board 22 would be compressed and deformed to absorb the shock and the slits 253 of the middle cushion member 25 provide more room for deformation. The more deformation energy is absorbed, the more comfort is provided. Thus, the middle cushion member 25 further enhances the cushion effect. The multi stages of cushion effects provided by the damper apparatus 2 according to the present invention makes the footwear more comfortable.

Moreover, the slits 253 provide the middle cushion member 25 more room to deform. In other words, the middle cushion member 25 having the slits 253 and the circular portions inside the annular slits 253 can deform more than the middle cushion member without any slit. That is the middle cushion member 25 according to the present invention can absorb more energy, which improves shock absorption and pressure release.

Furthermore, since the pad 3 includes the ventilation holes 31, the upper and lower boards 21, 22 include the ventilation holes 212, 222, and the middle cushion member 25 includes the cushion ventilation holes 252, as the damper apparatus 2 is subject to forces to bring about ascending/descending compression, air flows are generated in the shoe body 1 as shown in FIG. 7.

Although the embodiments of the present invention show the damper apparatus 2 operating in conjunction with the shoe body 1, the damper apparatus 2 can also be used in other footwear, such as slippers, sandals, etc.

In view of the above, the damper apparatus 2 provided at the insole portion 11 of the shoe body 1 is capable of generating different degrees of the rising and lowering of the heights depending upon different reaction forces and is capable of immediately distributing and absorbing different pressures exerted by the front and rear of the foot 4 during walking, running and jumping as well as generating air flows at the insole portion 11 such that the effects of shocking absorbing and pressuring releasing of the footwear are greatly enhanced in addition to the improved wearing comfort and air flows of the shoe body 1, which is not only inventive, practical to actual uses of the user but also of the above merits.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A shock absorbing and pressure releasing damper apparatus for footwear, comprising:

an upper board having a plurality of upper mounting portions disposed on a bottom of the upper board;

a lower board disposed below the upper board, the lower board having a plurality of lower mounting portions disposed on a top of the lower board and corresponding to the upper mounting portions of the upper board;

a middle cushion member disposed between the upper board and the lower board, the middle cushion member including a plurality of confining through holes corresponding to the upper mounting portions of the upper board and the lower mounting portions of the lower board;

a plurality of elastic members arranged between the upper mounting portions of the upper board and the lower mounting portions of the lower board, the elastic members received in the confining through holes of the middle cushion member; and a plurality of magnetic members arranged in the upper mounting portions of the upper board and the lower mounting portions of the lower board and at centers of the elastic members, the magnetic members having magnetic polarities;

wherein a plurality of annular slits are defined in the middle cushion member for absorbing deformation energy with each annular slit being attached to and blocked by a circular portion of the middle cushion member without penetrating through the middle cushion member.

2. The shock absorbing and pressure releasing damper apparatus according to claim 1, wherein the upper board and the lower board include a plurality of ribs.

3. The shock absorbing and pressure releasing damper apparatus according to claim 1, wherein the upper mounting portions of the upper board and the lower mounting portions of the lower board are of an outwardly protruding shape, fixation spaces are disposed at inner and outer of the upper mounting portions of the upper board, and fixation spaces are disposed at inner and outer of the lower mounting portions of the lower board.

4. The shock absorbing and pressure releasing damper apparatus according to claim 1, wherein the upper mounting portions of the upper board are defined with inner and outer fixation spaces forming an inward step, and the lower mounting portions of the lower board are defined with inner and outer fixation spaces forming an inward step.

5. The shock absorbing and pressure releasing damper apparatus according to claim 1, wherein the elastic members are springs.

6. The shock absorbing and pressure releasing damper apparatus according to claim 1, wherein the magnetic polarities disposed at the upper and lower mounting portions of the upper and lower boards are of like poles repelling each other.

7. The shock absorbing and pressure releasing damper apparatus according to claim 1, wherein the damper apparatus operates in conjunction with a shoe body, and the shoe body includes an insole portion having a receiving portion for accommodating the damper apparatus.

8. The shock absorbing and pressure releasing damper apparatus according to claim 1, wherein the upper board includes a plurality of ventilation holes.

9. The shock absorbing and pressure releasing damper apparatus according to claim 1, wherein the lower board includes a plurality of ventilation holes.

10. The shock absorbing and pressure releasing damper apparatus according to claim 1, wherein a pad with ventilation holes is disposed on the damper apparatus.

11. The shock absorbing and pressure releasing damper apparatus according to claim 1, wherein the middle cushion member includes a plurality of cushion ventilation holes.

12. The shock absorbing and pressure releasing damper apparatus according to claim 1, the middle cushion member is made of a foam material.

13. The shock absorbing and pressure releasing damper apparatus according to claim 12, the middle cushion member is made of a memory foam.

14. The shock absorbing and pressure releasing damper apparatus according to claim 1, wherein the elastic member includes a first elastic member and a second elastic member disposed in the first elastic member.

15. The shock absorbing and pressure releasing damper apparatus according to claim 1, wherein the upper board includes a plurality of massage members disposed on a top thereof.

* * * * *